US006004194A

United States Patent [19]

Hild et al.

[11] Patent Number: 6,004,194

[45] Date of Patent: Dec. 21, 1999

[54] ELECTRIC HAND-OPERATED GRINDER

[75] Inventors: Eugen Hild, Aichtal; Joao Bergner, Aidlingen; Rudolf Fuchs, Neuhausen, all of Germany

[73] Assignee: Robert Bosch GmbH, Stuttgart, Germany

[21] Appl. No.: 08/930,155

[22] PCT Filed: Mar. 13, 1997

[86] PCT No.: PCT/DE97/00496

§ 371 Date: Oct. 6, 1997

§ 102(e) Date: Oct. 6, 1997

[87] PCT Pub. No.: WO97/42002

PCT Pub. Date: Nov. 13, 1997

[30] Foreign Application Priority Data

May 2, 1996 [DE] Germany ..... 196 17 572

[51] Int. Cl.[6] ..... B24B 23/00; B24B 27/08

[52] U.S. Cl. ..... 451/357; 451/356; 451/351; 451/344; 451/359; 451/360

[58] Field of Search ..... 451/357, 356, 451/344, 351, 359, 360, 162, 166, 459, 490

[56] References Cited

U.S. PATENT DOCUMENTS 5,309,682 5/1994 Gutknecht et al. ..... 451/490
5,398,454 3/1995 Berner ..... 451/357
5,470,272 11/1995 Kikuchi et al. ..... 451/356
5,709,595 1/1998 Berger et al. ..... 451/357

FOREIGN PATENT DOCUMENTS

0610801A1 8/1994 European Pat. Off. .

*Primary Examiner*—Robert A. Rose
*Assistant Examiner*—George Nguyen
*Attorney, Agent, or Firm*—Michael J. Striker

[57] ABSTRACT

In a hand-held electrical grinder with a tool holder (22) driven by a rotating eccentric plug (20) which, for receiving a grinding tool has a quick-action locking device (24) with locking elements (40, 41) fixed on the tool and tool holder sides and corresponding with each other, the locking elements (40) on the tool side are formed, on the one hand, by hooks (42) disposed on a circular line and, on the other hand, the locking elements (41) on the holder side are realized by means of a spring wire (43), which is bent in the shape of a ring, in order to transmit a greater output from the tool holder (22) to the (10). The spring wire (43) has a number of radially inward directed indentations (431) corresponding to the number of the hooks (42) on the tool side, which extend behind the hooks (42) on the tool side for locking the grinding tool (10) in.

14 Claims, 4 Drawing Sheets

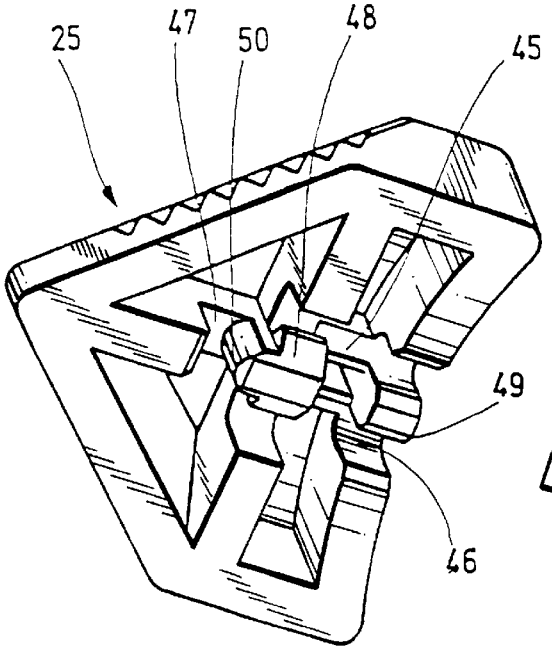
FIG. 5
FIG. 6
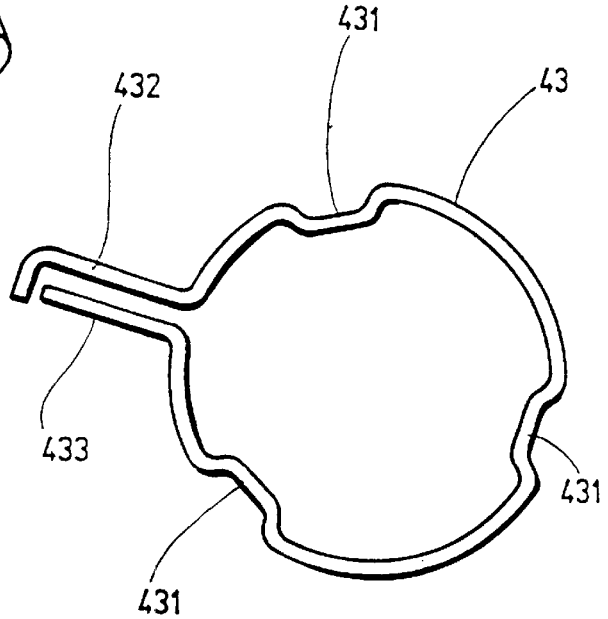
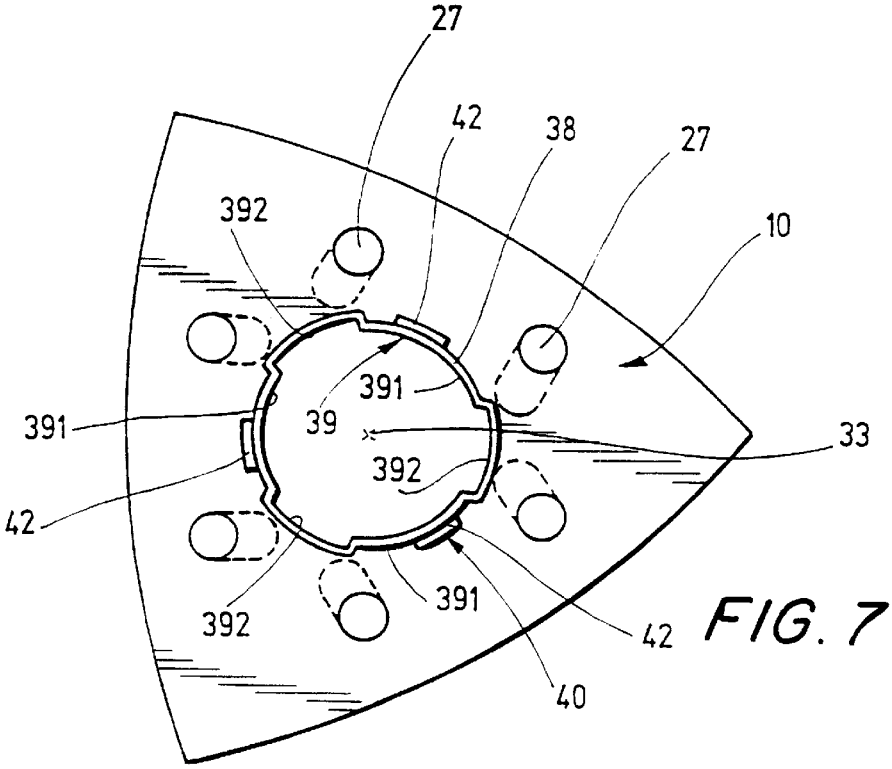
FIG. 7

ELECTRIC HAND-OPERATED GRINDER

BACKGROUND OF THE INVENTION

The invention relates to a hand-held electrical grinder.

In connection with known hand-held electrical grinders of this type with a grinding tool embodied as a triangularly-shaped grinding plate (EP 0 610 801 A1), the locking elements of the quick-action locking device on the holder side have a bar which is of one piece with the operating key, which can be displaced against the force of a pressure spring and which has a recess with two inclined faces constituting a locking protrusion. The locking elements on the tool side are constituted by at least one detent hook, which is formed in one piece from the grinding plate and projects upward from it. With the grinding plate placed on the support face of the tool holder, the detent hook projects into the recess of the tool holder and the locking protrusion grips behind it under the force of the pressure spring. In order to be able to place the symmetrical grinding plate into the tool holder in arbitrary positions, respectively turned by 120°, a detent hook is arranged in each one of the three corners of the grinding plate. The interlocking elements arrested on the tool side are constituted by support claws, which are disposed in pairs in each corner of the grinding plate symmetrically in respect to the detent hook, while the corresponding interlocking elements fixed on the holder side are realized by means of two insertion openings, which are arranged on the side of the tool holder opposite the operating key. The operating key is displaced against the force of the spring for changing the grinding tool, because of which the detent protrusion releases the detent hook. Now the grinding plate can be manually pulled off the tool holder. When the grinding plate is reinserted, two of the support claws are inserted into the two insertion openings in the tool holder, and the grinding tool is pressed onto the support surface of the tool holder. In the course thereof the bar is pushed against the force of the pressure spring over the lower run-up inclination at the locking protrusion until the detent hook slides past the locking protrusion. The bar, which then springs back, pushes the locking protrusion behind the detent hook, by means of which the grinding tool is fixed immovably on the tool holder in the axial direction.

SUMMARY OF THE INVENTION

The hand-held electrical grinder with the distinguishing features of the invention has the advantage over this, that the quick-action locking device in accordance with the invention is very cost-effective to produce, impervious to dust, rugged and simple to handle and allows an increased output transfer from the tool holder to the grinding tool, which is held in a manner which is particularly fixed against pull, push and is tilt-resistant. Because of the design of the quick-action locking device in accordance with the invention, it is possible to use special grinding tools, such as flap grinding adapters, grinding tongues or grinding tubes, both during grinding from "below" and from "above" which, in the latter case, means that a grinding force can also be applied via the top of the special tool and absorbed by the tool holder.

By means of further measures, advantageous further developments and improvements of the hand-electrical grinder are possible. In accordance with a preferred embodiment of the invention, the spring wire is pivotably held in a plane parallel with the support surface on the tool holder, and is connected with an operating key. It has a number of radially inwardly directed indentations which essentially correspond to the number of hooks on the tool side and which extend behind the hooks in a pivot position of the spring wire constituting the locked position of the grinding tool. Considerable ease of operation during a tool change and simultaneously a great locking dependability for the grinding tool inserted into the tool holder is achieved by this structural design.

In accordance with a preferred embodiment of the invention, the spring steel is guided in transverse slits of strips which are arranged on a circular line, which is coaxial with the rotary bearing in such a way that in the locked position of the spring wire respectively one pair of strips is located on both sides of one of the indentations, and that the pairs of strips are offset in respect to each by preferably the same circumferential angles. The spring wire, bent in a ring-shape, terminates in two approximately radially diverging legs which are parallel with each other, one leg of which is bent at right angles at the free end in the direction in front of the other leg. The operating key is clipped to the free ends of the two legs. By means of this structural design it is possible to mount the spring wire and the operating key very simply and rapidly on the tool holder made in one piece of plastic.

In accordance with an advantageous embodiment of the invention, the interlocking elements fixed in place on the tool and the tool holder side are realized by two axially engaged polygonal profiles, which are arranged coaxially with the axis of the rotary bearing on facing sides of the grinding tool and the tool holder. In this case the polygonal profile on the tool side is preferably formed on the inside of a sleeve projecting away from the top of the grinding tool and preferably of one piece with it, and the polygonal profile on the holder side is formed on the outside of a plug, which projects away from the tool and preferably is of one piece with it and can be inserted into the sleeve. The hooks of the quick-action locking device constituting the locking elements on the tool side are advantageously formed on the outer wall of the sleeve. By means of this it is possible to simultaneously form all elements on the tool side and all elements on the holder side in the course of producing the grinding tool or the tool holder.

In accordance with an advantageous embodiment of the invention, the rotary bearing embodied as a ball bearing is received in the plug supporting the polygonal profile on the holder side, and during the production of the tool holder is extruded from plastic on the tool holder, together with a cap-like annular disk which partially covers the one front face of the ball bearing. The cap-like annular disk, which partially extends over the outer ring of the ball bearing, prevents plastic from flowing into the latter during the extrusion process. Not only is a production advantage achieved by extruding the ball bearing into the plug, which is of one piece with the tool holder, but the ball bearing is protected from dust during operation.

In accordance with a preferred embodiment of the invention, the design of the polygonal profile and the arrangement of the hooks on the tool side are provided in such a way that the grinding tool can be placed against the tool holder in several, preferably three, rotary positions, offset from each other by the same circumferential angles, around the rotary bearing axis. Because of this it is possible to position the grinding tool, which for example is embodied as a triangularly-shaped symmetrical grinding plate, rapidly and exactly offset by 120° in respect to its original position, so that when the grinding effect of the first corner area of the grinding plate and the abrasive sheet is reduced, for example because of wear or dirt, its second and third corner areas can be used in place of the first or second for further corner grinding, wherein the corner is always directly oriented toward the front.

In a further embodiment of the hand-held grinder, the tool holder has pin-shaped feet on a partial circle at the radial outer area of its surface facing the tool holder, which interlockingly extend into fitting recesses of the grinding plate and are used as a fixation against relative rotation of the grinding plate in respect to the tool holder, and by means of this make possible a very direct force transfer between the tool holder and the grinding plate.

Since the grinding tool is a wear item, the rapid repositioning of the corner areas in respect to the tool holder or the easy interchangeability of the grinding tool is of considerable advantage. This advantage arises from the cooperation of the detent means of the grinding tool with those of the tool holder. Therefore the tool holder as well as the grinding tool have features of the invention, wherein the tool holder also is an important component or replacement part, on which differently designed or equipped grinding tools can be lockingly exchanged or displaced in a releasable or lockable manner without auxiliary tools.

DRAWINGS

The invention will be explained in more detail in the following description by means of an exemplary embodiment represented in the drawings. Shown are in:

FIG. 1, a partial lateral view of a hand-held electrical grinder, partially in section.

FIG. 2, a perspective top view of a tool holder of the hand-held grinder of FIG. 1.

FIG. 3, a section along the line III—III in FIG. 2.

FIG. 4, a view from below of the tool holder in FIG. 2.

FIG. 5, a perspective view from below of an operating key of a quick-action locking device on the hand-held grinder in FIG. 1, shown enlarged.

FIG. 6, a view from below of a ring-shaped spring wire of the quick-action locking device on the hand-held grinder in FIG. 1;

FIG. 7, a top view of a grinding tool of the hand-held grinder in FIG. 1, and FIG. 8, a spatial view from below of a further exemplary embodiment of the tool holder in accordance with the invention.

FIG. 9, a top view on the upper side of a further preferred embodiment of the grinding tool.

DESCRIPTION OF THE PREFERRED EMBODIMENT

Figure 1:
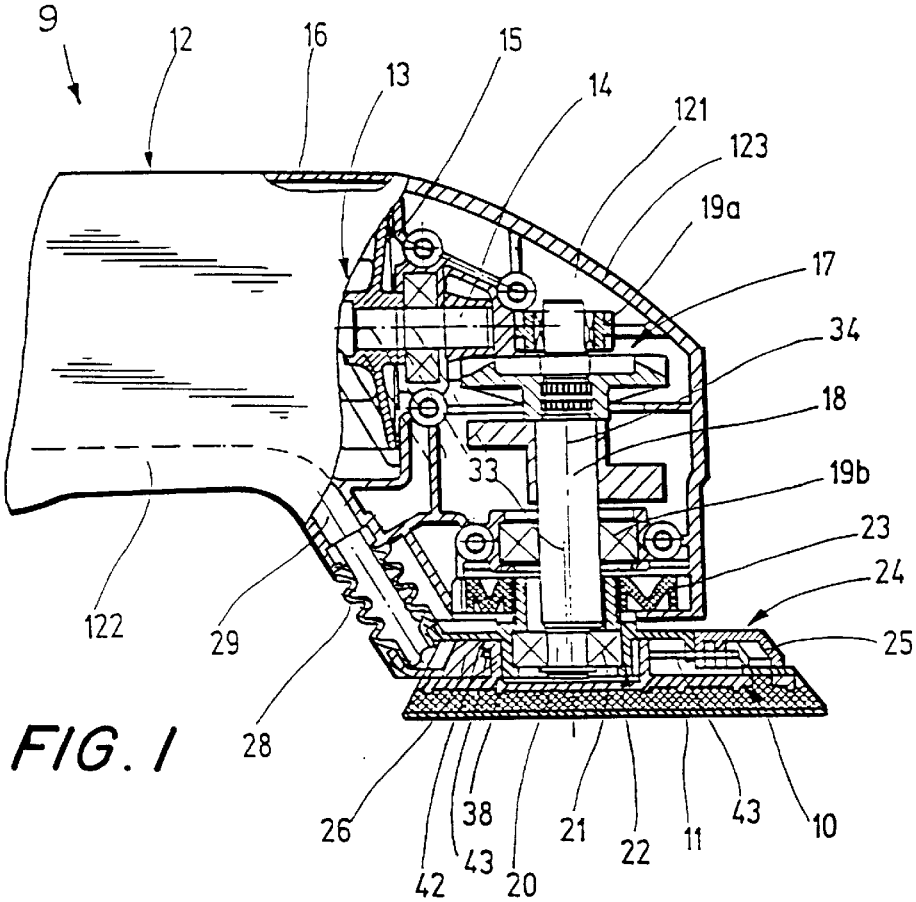

The hand held electrical grinder represented in a partial lateral view and partially in section in FIG. 1 is designed as a vibrating grinder 9 with a grinding tool 10 embodied as a triangularly-shaped symmetrical grinding plate. The underside of the grinding plate made of plastic is provided with a burr-type fastener coating 11 for receiving the abrasive sheets, not represented. The vibrating grinder has a double-shelled machine housing composed of two housing shells 121, 122, which abut each other along a separating seam 123. An electric motor 13 is received in the machine housing 12, of which only the fan 15 seated on the driveshaft 14 is visible. An on/off switch 16 disposed on the top of the machine housing 12 is used for switching the electric motor 13 on and off. Via an angled gear 17, the driveshaft 14 drives a work shaft 18, which is rotatably seated in two ball bearings 19*a* and 19*b*, which are disposed fixed in place on the housing, and which projects with an eccentric plug 20 out of the machine housing 12 at the lower front face. The inner ring of a further ball bearing 21 is seated undisplaceably on the eccentric plug 20 and its outer ring is held, in particular extruded into, a shell-shaped tool holder 22. The tool holder 22 made of plastic, which is shown enlarged in FIGS. 2 to 4 in various views, is fastened via a vibrating body 23 on the machine housing 12, so that it is prevented from being taken along in a rotating manner when the eccentric plug 20 rotates and therefore only performs a circular movement. The grinding tool 10 is fastened on the tool holder 22 by means of corresponding interlocking elements which—as will be explained in detail—are fixed in place on the tool holder side or the tool side, and are also held by means of a quick-action locking device 24, which can be manually actuated by means of an operating key 25. In this case the grinding tool 10 rests on a support surface 37, which is clearly emphasized by an advanced line, of the shell-shaped tool holder 22, and together with the tool holder 22 encloses a dust aspirating chamber 26 which, on the one hand, is open via suction holes 27 (FIG. 7) in the grinding tool 10 and respective corresponding holes in the abrasive sheets towards the side to be worked of a workpiece, not represented, and on the other hand is connected via a bellows bag 28 with a dust aspiration conduit 29 extending in the machine housing 12, to the end of which an external suction blower is to be connected.

Figure 2:
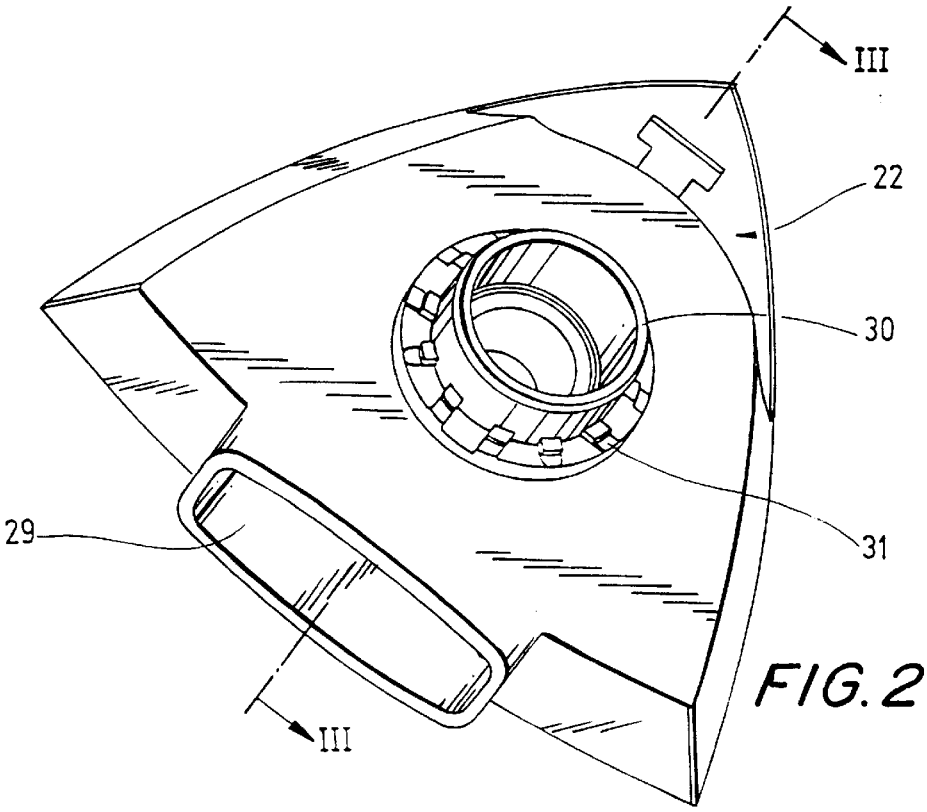

The tool holder 22 is represented enlarged in FIG. 2 in a perspective top view, in FIG. 4 in a view from below and in FIG. 3 in longitudinal section along the line III—III in FIG. 2. On its top remote from the grinding tool 10, it has a central ring connector 30, which can be pushed into the vibrating body 23 maintained in the machine housing 12 and is held, fixed against relative rotation, by means of cams 31 formed on the ring connector 30. A plug 32, hollow in the interior, extends coaxially with the ring connector 30 on the underside of the tool holder 22 facing the grinding tool 10, in which a ball bearing 21 is coaxially received. The aligned axes of the ring connector 30, the plug 32 and the ball bearing 21 are represented in dash-dotted lines in FIGS. 1 and 3 and identified by 33, while the axis of the work shaft 18, which is offset by the size of the eccentric, is identified by 34.

On the top, i.e. the side facing the vibrating grinder 9, the ring connector 30 with the cams 31 and the plug 32 with the tool holder 22 are of one piece and are formed in the course of the extrusion process. In the process, the ball bearing 21 is extruded in the course of the extrusion process into the plug 32, along with the a cap-shaped annular disk 35, which partially covers the one front face of the ball bearing 21, wherein the annular disk 35 prevents the plastic from flowing into the ball bearing 21.

Figure 4:
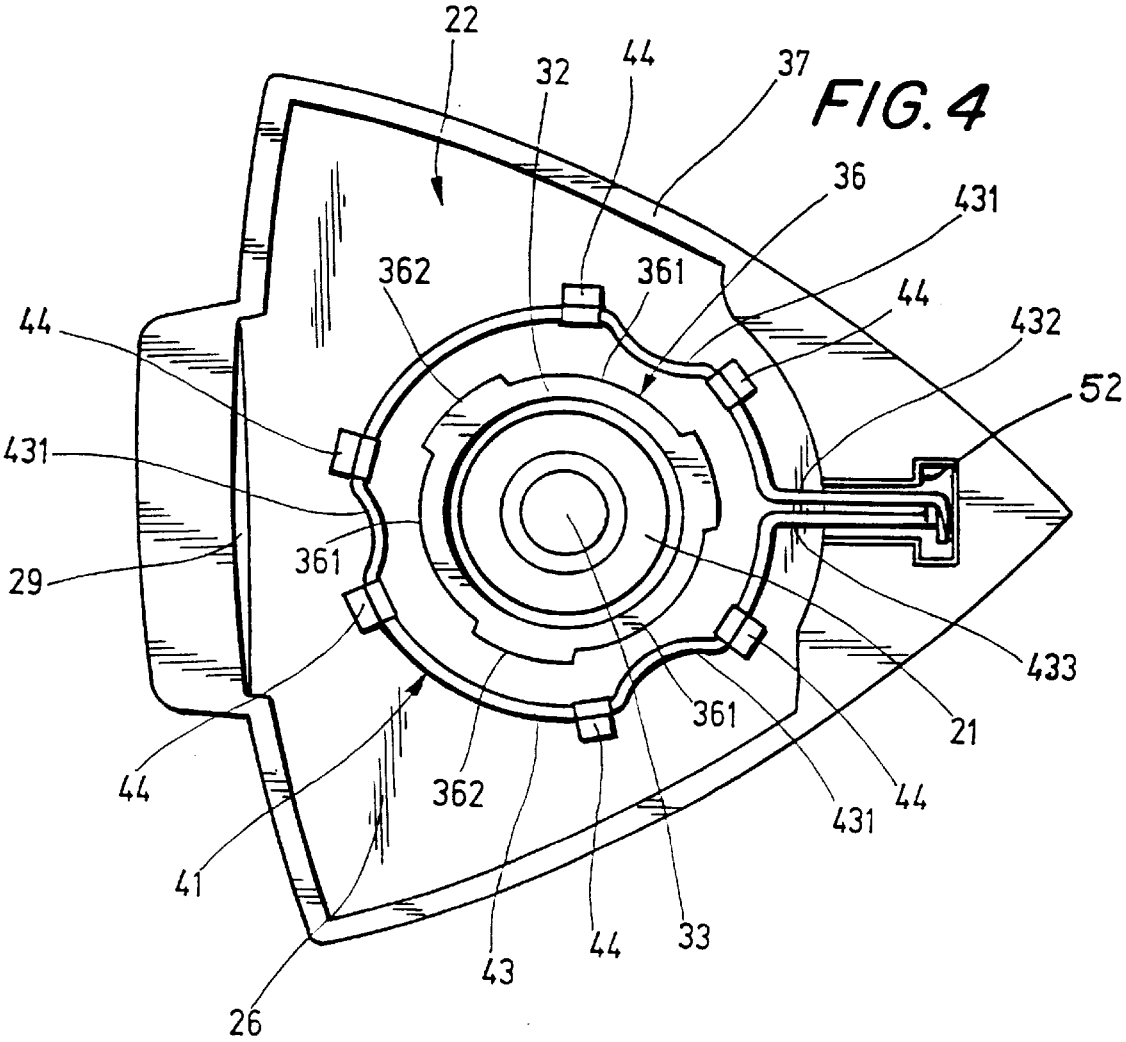

As can be seen in FIG. 4 in particular, a symmetrical polygonal profile 36 is formed on the underside of the tool holder 22 on the exterior of the plug 32, which consists of three equal circular arc sections 361 respectively offset from each other by 120°, which are connected by three equal circular arc sections 362 in the form of axial strips, also offset from each other by 120°, whose radius of arc is greater than that of the circular arc sections 361.

As can be seen from FIG. 7, which represents a top view on the top of the grinding tool 10, by means of which the grinding tool 10 is supported on the support surface 37 on the tool holder 22, a sleeve 38, which is of one piece with the grinding tool 10, extends away from the top of the grinding tool 10, on whose interior a negative or hollow polygonal profile 39, which corresponds with the polygonal profile 36 and has circular arc sections 391 and 392, is embodied, wherein the sections 392 are formed as axial grooves for receiving the axial strips defined by the circular arc sections 362, so that when the grinding tool 10 is placed on the support surface 37 on the tool holder 22, the two polygonal profiles 36, 39 are interlockingly engaged and fix the grinding tool 10 against relative rotation on the tool holder 22. Thus, the two polygonal profiles 36, 39 represent the previously mentioned interlocking elements between the tool holder 22 and the grinding tool 10, which are fixed on the side of the holder and the side of the tool and correspond with each other.

By means of the angularly symmetrical design of the polygonal profiles 36, 39 it is possible to place the grinding tool 10 on the tool holder 22 in three positions, which are respectively turned by 120° around the axis 33 in respect to each other. The quick-action locking device 24 fixes the grinding tool 10 on the tool holder 22 and prevents the unintended removal of the grinding tool 10 from the plug 32. To this end, the quick-action locking device 24 has locking elements 40, fixed in place on the tool side, and locking elements 41 corresponding with them and fixed in place on the holder side.

As can be seen from FIGS. 1 and 7, the locking elements 40 on the tool side are embodied as hooks 42, formed in one piece on the grinding tool 10, which are arranged offset by equal angles of rotation on a circular line and project away from the top of the grinding tool 10 facing the support surface 37 on the tool holder 22. For the sake of simplicity, the hooks 42 are here formed on the exterior of the sleeve 36, whose interior surface supports the polygonal profile 39. The locking elements 41 on the holder side, which cooperate with this, are constituted by a circularly bent spring wire 43 represented in FIGS. 4 and 6. The spring wire 43 has a number of radially inwardly oriented indentations 431 corresponding to the number of hooks 42 on the sleeve 38, three in this case, which are, corresponding to the hooks 42, also arranged offset by the same angles of rotation in respect to each other.

Figure 3:
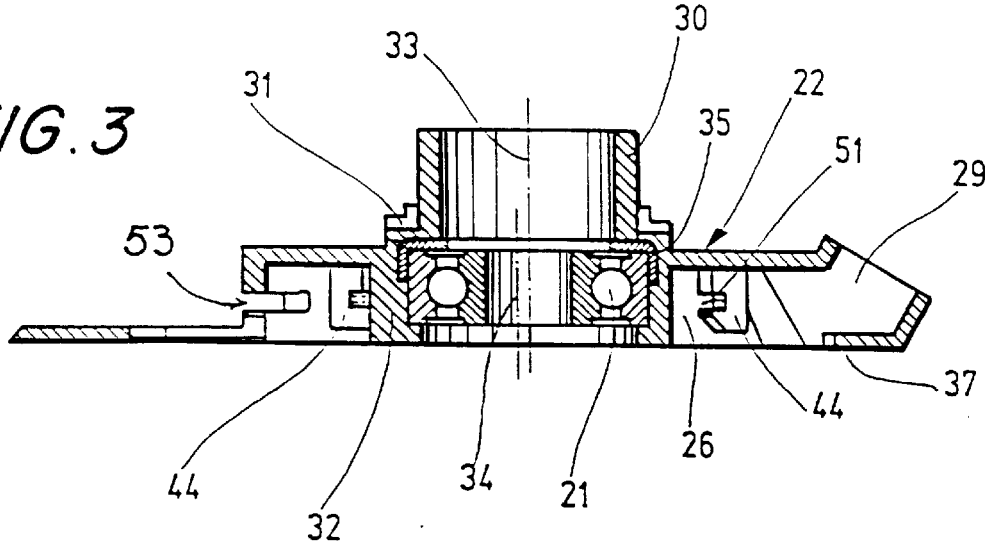

As can be seen from FIGS. 3 and 4, the spring wire 43 bent in the shape of a ring is received on the tool holder 22 in transverse slits 53 of strips 44 in a rotatable manner, or pivotable by means of its legs 432, 433 in the guide slit 53 toward one side, in FIG. 3 into the drawing plane, which strips are arranged on a partial circle which is coaxial with the axis 33 of the plug 32 or of the ball bearing 21 and project away downward from the tool holder 22, with which they are of one piece. The strips 44 are arranged in pairs in such a way that in the locked position of the spring wire 43, such as represented in FIG. 4, a pair of strips is respectively located on both sides of an indentation 431. The pairs of strips are in turn again offset by equal circumferential angles from each other. The spring wire 43 bent in the shape of a ring terminates in two parallel legs 432 and 433, which extend away approximately radially. The end of the one leg 432 is bent away at right angles and is located in front of the straight end of the leg 433. The legs 432, 433 enter through the opening 52 in the forward tip of the tool holder 22.

The operating key 25 of the quick-action locking device 24 can be clipped to the free ends of the legs 432, 433 and is supported in this way by the spring wire 43. To this end the operating key 25 has appropriate grooves and detent protrusions on its underside, such as represented in FIG. 5. In the process the leg 432 of the spring wire 43 (FIG. 6) is pressed into the groove 45, wherein its bent end comes to rest in the transverse groove 47, while the other leg 433 is clipped into the groove 46. The detent protrusions 48 to 50 respectively associated with the grooves 45 to 47 assure a dependable connection between the legs 432, 433 and the operating key 22. It is now possible by means of the operating key 25 to pivot the spring wire 43 guide in the transverse slits 51 of the strips 44 in the spring wire plane, because of which the indentations 431, which in the locking position extend behind the hooks 42, slide away from the hooks 42, so that the portions of the spring wire 43 which lie radially further outward move into the places of the indentations 431 and thereby release the hooks 42. Thereafter the grinding tool 10 can be manually pulled off the tool holder 22 in the direction of the axis 33. In this position of the quick-acting locking device 24, the grinding tool 10 can be changed and—in the mentioned embodiment of the grinding tool 10 as a triangularly-shaped symmetrical grinding plate—can be again inserted, respectively turned by 120° and with one corner forward, into the tool holder 22. In this way an even wear of the corner areas of the abrasive sheets is made possible, without it being necessary to remove them from the burr-type fastener coating of the tool holder 22. Following the insertion of the grinding tool 10 by fitting the two polygonal profiles 36, 39 together and placing the grinding tool 10 on the support surface 37 of the tool holder 22, the operating key 25 is pivoted back (clockwise in FIG. 4), until the spring wire 43 takes up the locking position represented in FIG. 4. Then the indentations 431 of the spring wire 43 again reach behind the hooks 42 of the grinding tool 10, and the latter is securely locked onto the tool holder 22. With an appropriate design of the locking elements 40 on the tool side, for example as resilient tongues with the hooks 42 on the free end, and a correspondingly resilient embodiment of the spring wire 43 or the indentations 431, the grinding tool 10 can be clipped to the tool holder 22. In this case the operating key 25 can be omitted, the same as the rotatable reception of the spring wire 43 in the transverse slits 51 of the strips 44.

Figure 8:
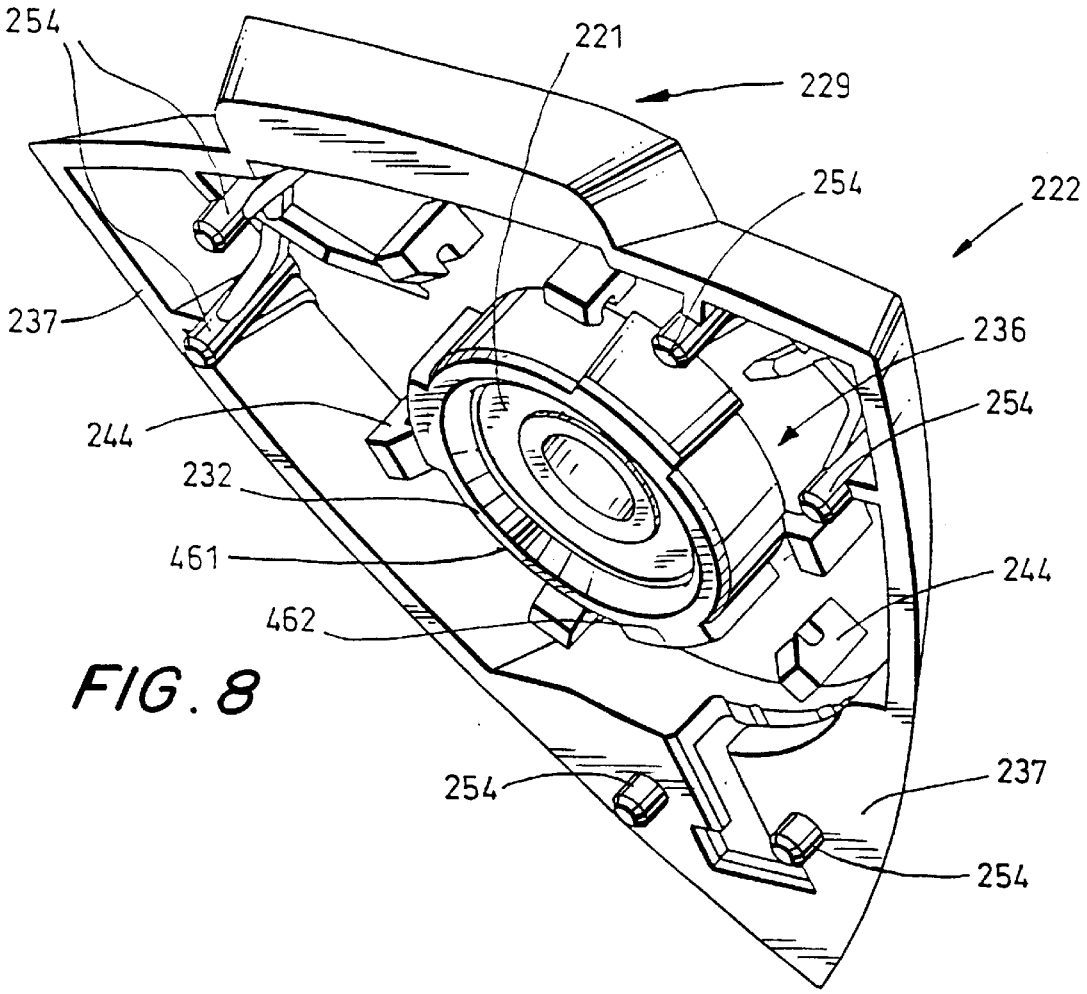

The spatial view of the underside of a further exemplary embodiment of the tool holder 222 represented in FIG. 8 goes further than the exemplary embodiment in accordance with FIG. 4, in that it has six cylindrical, pin-like feet 254 with ball-shaped or bezeled free end projecting downward at right angles over the underside or support surface 237.

The tool holder 222 has an aspirating conduit 229, a symmetrical polygonal profile 236 with equal circular arc sections 461, 462 which are respectively offset in respect to each other by 120°, strips 244 without a spring wire or an operating key as well as a recess 252 for the passage of the legs of the spring wire in accordance with FIG. 4.

Figure 9:
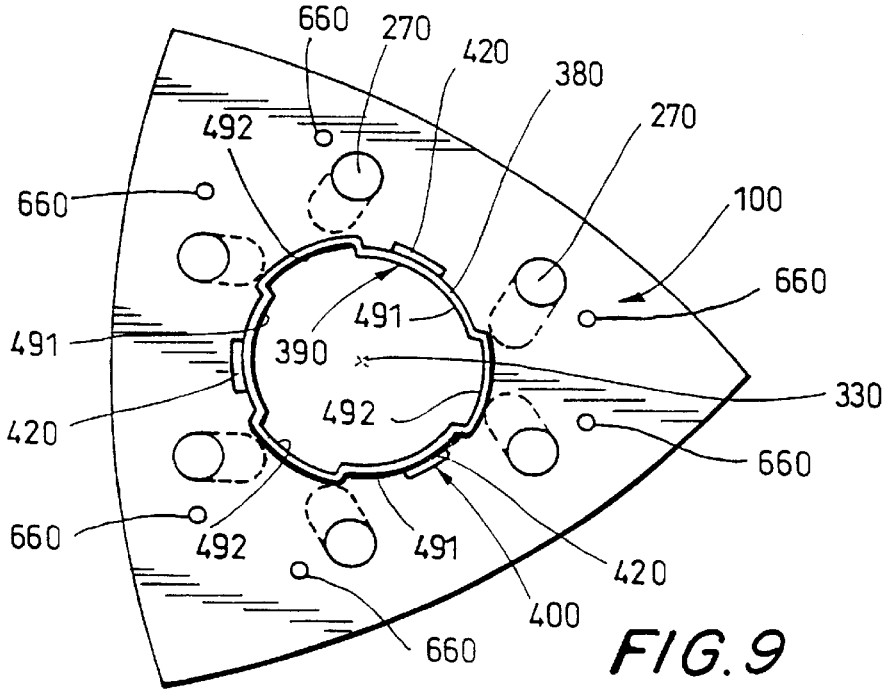

With the area extending past the support surface 237, the feet 254 engage essential play-free matching guide holes 660 of a grinding plate 100 represented in FIG. 9 which, except for the guide holes 660, corresponds to the one in accordance with FIG. 7.

A fixation against relative rotation in addition to the polygonal profiles 236, 390 of the tool holder 222 and the grinding plate 100, which engage the sleeve 380, 390 of the grinding plate or the grinding tools 100 in accordance with FIG. 9, is created by the interlocking engagement of the feet 254 with the guide holes 660 of the grinding plate 100. By means of this additional fixation against relative rotation a particularly rigid arrestment of the grinding plate 100 in respect to the tool holder 222 is assured. By means of this the precision in the guidance of the grinding plate over the workpiece surface to be processed is improved.

FIG. 9 shows a top view on the upper side of a further exemplary embodiment of the grinding tool 100 which, except for the guide holes 660, corresponds to the grinding tool 10 in accordance with FIG. 7, and is provided for coupling with the tool holder 222 in accordance with FIG. 8.

The grinding tool 100 is supported on the support surface 237 on the tool holder 222 in accordance with FIG. 8. A sleeve 380, which is of one piece with the grinding tool 100, extends from the surface of the grinding tool 100, on whose inside a negative or hollow polygonal profile 390 with circular arc sections 491 and 492 is formed, which corresponds to the polygonal profile 236 of the tool holder 222. When placing the grinding tool 100 on the support surface 370 on the tool holder 222, the two polygonal profiles 236, 390 come into interlocking engagement with each other and fix the grinding tool 100 secure against relative rotation on the tool holder 222. The two polygonal profiles 236, 390 constitute the two interlocking elements mentioned between the tool holder 222 and the grinding tool 100, and are fixed on the holder side and the tool side and correspond to each other.

We claim:

1. A hand-held electrical grinder with an interchangeable, at least partially plate-shaped grinding tool (10) with a tool holder (22) seated with the interposition of a rotary bearing (21) on a rotating eccentric plug (20), on whose underside facing away from the machine, supports (37) for the grinding tool (10) are formed, and with a quick-acting locking device (24), which has locking elements (40, 41), which are fixed in place on the tool and the tool holder sides and correspond with each other, for fixing the grinding tool (10) on the tool holder (22), characterized in that hooks (42), arranged on a circular line and preferably projecting away from the top of the grinding tool facing the tool holder (22), are used as locking elements (40) on the tool side, and that a spring wire (43) bent in a ring shape is used as the locking element (41) on the tool holder side and is arranged so that the hooks (42) can extend behind it.

2. The hand-held grinder in accordance with claim 1, characterized in that the spring wire (43) is pivotably maintained on the tool holder (22) in a plane which is parallel with the support (37) on the tool holder (22) and is connected with an operating key (25), and that the spring wire (43) has a number of radial deformations essentially corresponding to the number of the hooks (42) on the tool side, preferably inward oriented indentations (431) which, in a pivot position of the spring wire (43) constituting the locking position for the grinding tool (10), extend behind the hooks (42) on the tool side and, in another pivot position of the spring wire (43), release the hooks (42).

3. The hand-held grinder in accordance with claim 1 or 2, characterized in that the spring wire (43) is displaceably received on the tool holder (22) in transverse slits (51) of strips (44), which are arranged on a partial circle which is coaxial with the rotary bearing axis (33) in such a way, and which are preferably embodied to be of one piece with the tool holder (22), that in the locking position of the spring wire (43) respectively one pair of strips rests on both sides of one of the indentations (431), and that the pairs of strips are offset in respect to each other, preferably by equal circumferential angles.

4. The hand-held grinder in accordance with one of claims 1 to 3, characterized in that the ring-shaped spring wire (43) terminates in two legs (432, 433), which extend away approximately radially and are parallel with each other, of which one leg (432) is bent at right angles in front of the other leg (433), and that the operating key (25) is clipped to the free ends of the two legs (432, 433).

5. The hand-held grinder in accordance with the preamble of claim 1, in particular in accordance with one of claims 1 to 4, with elements disposed on the tool and tool holder side which correspond with each other, for the fixation against relative rotation of the grinding tool (10) on the tool holder (22), characterized in that the interlocking elements on the tool and tool holder side are realized by axially engaged polygonal profiles (36, 39), which are arranged coaxially in respect to the rotating bearing axis (33) on facing sides of the tool holder (22) and the grinding tool (10).

6. The hand-held grinder in accordance with claim 5, characterized in that the polygonal profile (39) on the tool side is preferably formed on the inside of a sleeve (38) projecting away from the top of the grinding tool (10) and preferably is of one piece with it, and the polygonal profile on the holder side (36) is formed on the underside of a plug (32), which projects away from the tool holder (22) and preferably is of one piece with it and can be inserted into the sleeve (38), and that the hooks (42) of the quick-action locking device (24) constituting the locking elements (40) on the tool side are formed on the outer wall of the sleeve (38) of one piece with it and projecting away radially.

7. The hand-held grinder in accordance with claim 5 or 6, characterized in that the design of the polygonal profile (36, 39) and the arrangement of the hooks (42) on the tool side is provided in such a way that the grinding tool (10) can be placed against the tool holder (22) in several, preferably three, rotary positions, offset from each other by the same circumferential angles, around the rotary bearing axis (33).

8. The hand-held grinder in accordance with claim 6 or 7, characterized in that the rotary bearing embodied as a ball bearing (21) is arranged in the plug (32), and during the production of the tool holder (22) from plastic is extruded on the tool holder (22), together with a cap-like annular disk (35) which partially covers the one front face of the ball bearing (21).

9. The hand-held grinder in accordance with claim 8, characterized in that the tool holder (222) has feet (254) which, as an additional fixation against relative rotation of the grinding plate (100) in respect to the tool holder (222), can be interlockingly inserted into the grinding plate (100).

10. A grinding tool for being received in a tool holder (22) of a hand-held grinder, characterized by a polygonal profile (39), which is disposed on its side facing the tool holder (22) and rotatably engageable into a corresponding polygonal profile (36) of the tool holder (22).

11. The grinding tool in accordance with claim 10, characterized in that the polygonal profile (39) has radially projecting hooks (42) for the axial fixation on the tool holder (22).

12. The grinding tool in accordance with claim 11, characterized in that it has guide holes (660) for engagement of the feet (254) of the tool holder (222).

13. The grinding tool in accordance with claim 10, characterized in that the polygonal profile 39 is symmetrical.

14. A grinding tool embodied as a grinding plate for being received in a tool holder (22) of a hand-held grinder, characterized by a polygonal profile (39), which is disposed on its side facing the tool holder (22) and rotatably engageable in the corresponding polygonal profile (36) of the tool holder (22).

* * * * *